US005223669A

United States Patent [19]

Kanba et al.

[11] Patent Number: 5,223,669

[45] Date of Patent: Jun. 29, 1993

[54] MAGNET ROLL

[75] Inventors: Seigo Kanba, Yasugi; Yasuo Sawano, Saitama; Tadashi Aihara, Kumagaya; Takaski Miyaji, Nara; Yoshikazu Nishikawa, Nara, all of Japan

[73] Assignee: Hitachi Metals, Ltd., Tokyo, Japan

[21] Appl. No.: 781,757

[22] Filed: Oct. 23, 1991

[30] Foreign Application Priority Data

Oct. 26, 1990 [JP] Japan ..... 2-289675

[51] Int. Cl.[5] ..... G03G 15/09

[52] U.S. Cl. ..... 118/658; 355/251

[58] Field of Search ..... 118/656, 657, 658; 355/250, 251, 252, 253

[56] References Cited

U.S. PATENT DOCUMENTS

| | | | |
|---|---|---|---|
| 3,927,463 | 12/1975 | Dupree | 29/447 |
| 4,493,550 | 1/1985 | Takekida | 355/10 |
| 4,526,130 | 7/1985 | Fukuda et al. | 118/657 |
| 4,526,618 | 7/1985 | Keshavan et al. | 106/1.05 |
| 4,656,965 | 4/1987 | Hosoya et al. | 118/649 |
| 4,728,987 | 3/1988 | Piola et al. | 355/3 DD |
| 4,748,736 | 6/1988 | Miihkinen | 29/527.2 |
| 5,078,088 | 1/1992 | Nishikawa | 118/659 |
| 5,111,567 | 5/1992 | Leino et al. | 29/132 |

FOREIGN PATENT DOCUMENTS

| | | |
|---|---|---|
| 86869 | 5/1982 | Japan . |
| 118270 | 7/1982 | Japan . |
| 138261 | 6/1986 | Japan . |

*Primary Examiner*—Leo P. Picard
*Assistant Examiner*—Raymond Barrera
*Attorney, Agent, or Firm*—McGlew and Tuttle

[57] ABSTRACT

A magnet roll comprising a permanent-magnet member having a plurality of magnet poles extending axially on the outer circumferential surface thereof, and a hollow cylindrical sleeve, made of a non-magnetic material, both constructed in mutually rotatable fashion via a flange provided on both ends thereof; the surface of the sleeve being coated with a stainless-steel metal-spraying material containing more than 20% chromium.

8 Claims, 3 Drawing Sheets

MAGNET ROLL

BACKGROUND OF THE INVENTION

This invention relates generally to a used as developing rolls in electrophotography and electrostatography, and more particularly to a magnet roll which is modified to improve the transferability of a developer and wear resistance.

DESCRIPTION OF THE PRIOR ART

In general, magnet rolls used as developing rolls in electrophotography, electrostatography, etc. have a construction as shown in FIG. 1. In FIG. 1, reference numeral 1 refers to a permanent-magnet member, which is obtained by sintering powder magnet material, such as hard ferrite, for example, into a cylindrical shape, or integrally forming a mixture of ferromagnetic material and a binder into a cylindrical shape, with a shaft 2 concentrically bonded at the center thereof. On the outer circumferential surface of the permanent-magnet member 1 provided are a plurality of magnetic poles (not shown) extending axially. Flanges 3 and 4 are rotatably fitted to both ends of the shaft 2 via bearings 5 and 5; a hollow cylinderical sleeve 6 being fitted to the flanges 3 and 4. The flanges 3 and 4, and the sleeve 6 are made of a non-magnetic material, and is an aluminum alloy or stainless steel. Numeral 7 refers to a sealing member fitted between the flange 3 and the shaft 2. The permanent-magnet member 1 typically has a diameter of 20–60 mm, and a length of 200–300 mm.

With the above construction, predetermined developing operation is effected since the relative revolution of the permanent-magnet member 1 and the sleeve 6 (by causing the shaft 8 to rotate, with the permanent-magnet member 1 kept stationary) serves as a magnetic brush, attracting magnetic developer on the outer circumferential surface of the sleeve 6. Usually, two component developer comprising magnetic carrier and toner, or one component developer comprising magnetic toner, is mainly used as the magnetic developer.

In the magnet roll having the aforementioned construction, a means for roughening the surface of the sleeve 6 is employed to improve the transferability of a developer. In U.S. Pat. No. 4,030,447, a surface treatment method using knurling was disclosed, and U.S. Pat. No. 4,597,661, a surface treatment method using blasting was disclosed. The roughening of the surface of the sleeve 6 by knurling involves increased machining time and manhours. It is particularly unfavorable for a sleeve 6 made of a material having low machinability, such as stainless steel. A sleeve 6 made of a soft material, such as aluminum alloy (A5056, A6063, A2017 or the like) has low wear resistance, leading to shorter service life. Furthermore, sand blasting or shot balsting the surface of a sleeve 6 made of stainless steel could not contribute much to improved wear resistance though the surface can be slightly hardened due to working strains. In addition to these, the method of forming an anodic oxidation coating film ("Alumite" which is a tradename in Japan) on the surface of a sleeve 6 made of an aluminum alloy is well known as a means for increasing the surface hardness of a sleeve 6. The anodic oxidation coating film showing insulating properties cannot achieve satisfactory results when electrial conductivity is required between the surface of a sleeve 6 and the magnetic developer transferred on this sleeve 6.

As a means for solving these problems, the method of forming a layer consisting of stainless steel on the surface of a sleeve 6 made of a non-magnetic material, such as aluminum alloy, by means of a binder or with a metal spraying means has been proposed (refer to U.S. Pat. No. 3,246,629, and Japanese Published Unexamined Patent No. 23173/1986, for example).

A sleeve 6 made of an aluminum alloy, however, could be heated up due to the eddy current produced in the sleeve 6 by the relative revolution of the sleeve 6 and the permanent-magnet member 1. To cause the magnet roll to rotate at high speed (at 1,000 rpm, for example) to achieve high-speed development, driving torque would have to be increased. This would lead to increased power consumption.

Although a sleeve 6 made of stainless steel is effective for high-speed revolution, it is also effective to form a layer consisting of stainless steel on the surface of the sleeve 6 by means of a metal spraying means. When a metal sprayed film consisting of stainless steel is provided on a sleeve made of stainless steel, the metal-sprayed film tends to cause rust. When rust is caused, the rust formed tends to be peeled off, falling into the developer, leading to poor image quality. This is attributable to the change in the chemical composition of the metal sprayed film resulting from the effects of the heat caused during metal spraying, resulting in the local dispersion of chromium. This leads to the formation of local cells between the metal sprayed film and the base metal.

SUMMARY OF THE INVENTION

It is the first object of this invention to provide a magnet roll useful for high-speed revolution.

It is the second object of this invention to provide a magnet roll that can improve the transferability of a developer.

It is the third object of this invention to provide a magnet roll having high wear resistance and long service life.

It is the fourth object of this invention to provide a magnet roll that prevents chromium from being dispersed in a metal sprayed film formed on the surface of a sleeve.

DETAILED DESCRIPTION OF THE EMBODIMENTS

First, a sleeve was prepared by forming a hollow tube (outside diameter: 20 mm, wall thickness: 1 mm) made of SUS304 (Cr: 18.0–20.0%, Ni: 8.0–10.5%), and providing a 30-μm metal sprayed film by arc-spraying a spraying metal consisting of SUS310S (Cr: 24.0–26.0%, Ni: 12.0–15%) on the surface of the hollow tube. As a comparative example, another sleeve was prepared by arc-spraying a spraying metal consisting of SUS316L (Cr: 16.0–18.0%, Ni: 12.0–15.0%) and SUS202 (Cr: 17.0–19.0%, Ni: 4.0–6.0%) to form a similar metal-sprayed film to the aforementioned example. These hollow tubes were subjected to an acceleration test by allowing them to stay in an atmosphere of temperature 40° C. and relative humidity of 90% to observe the surface of the metal-sprayed films. Then, the surface of the metal-sprayed film was observed.

Figure 2:
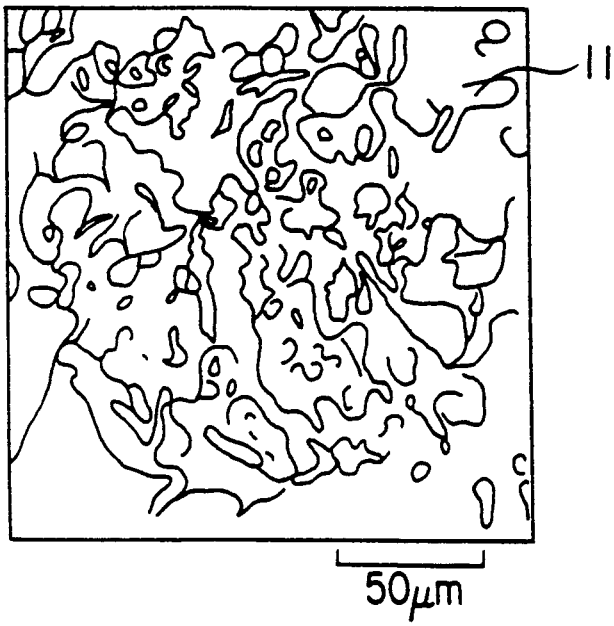
FIG. 2 is a schematic diagram of an electron micrograph illustrating the state of the surface of a sleeve in an embodiment of this invention.
Figure 3:
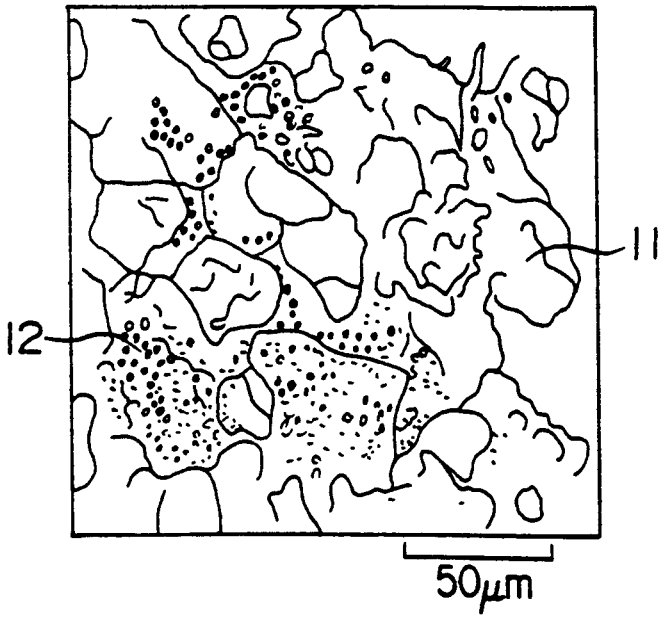
FIG. 3 is a schematic diagram of an electron micrograph illustrating the state of the surface of a sleeve in a comparative example.

FIGS. 2 and 3 are schematic diagrams of the electron micrographs showing the surface state of the sleeve in the embodiment of this invention and the comparative example. In the comparative example shown in FIG. 3, spotted or millet-grain-shaped rust 12 was found scattered inside the metal-sprayed film 11. Brownish rust was therefore found produced on the overall surface of the comparative example in visual inspection. In the embodiment of this invention, on the other hand, no rust was observed on the surface of the sleeve with the naked eye. Even in the electron-microscopic observation, no rust was found in the metal-sprayed film 11, and the metal-sprayed film 11 was quite uniformly dispersed on the surface of the sleeve, as shown in FIG. 2.

The table below shows the results of analysis on chromium contents using the scanning electron micrograph (SEM).

| | (Unit: wt. %) | | |
|---|---|---|---|
| Metal-sprayed film | SUS310S | SUS316S | SUS202 |
| Normal portions | 28.8 | 17.8 | 19.5 |
| Low-Cr portions | 13.0 | 2.3 | 1.9 |

As is apparent from the table above, the normal portions of the SUS316S and SUS202 metal-sprayed films in the comparative examples have almost the same chromium contents as with the metal-spraying material, while the low-chromium portions have extremely low chromium contents and a significant change in chemical composition due to the loss of chromium caused by the heat applied during metal spraying. This probably resulted in the formation of rust 12 shown in FIG. 2. The embodiment of this invention using SUS310S as the metal spraying material, on the other hand, has a chromium content as high as 13.0% even in the low-chromium portions. Thus, the metal-sprayed film 11 is quite sound, with no rust found therein, as shown in FIG. 2.

In this invention, the metal-sprayed film has both high-chromium normal portions and low-chromium portions (though the normal portions remain dominant). To prevent rusting, the chromium content of the normal portions in the metal-sprayed film should preferably be over 20 wt.%, and the low-chromium portions in the metal-sprayed film should preferably have chromium contents more than 10 wt.%.

Figure 4:
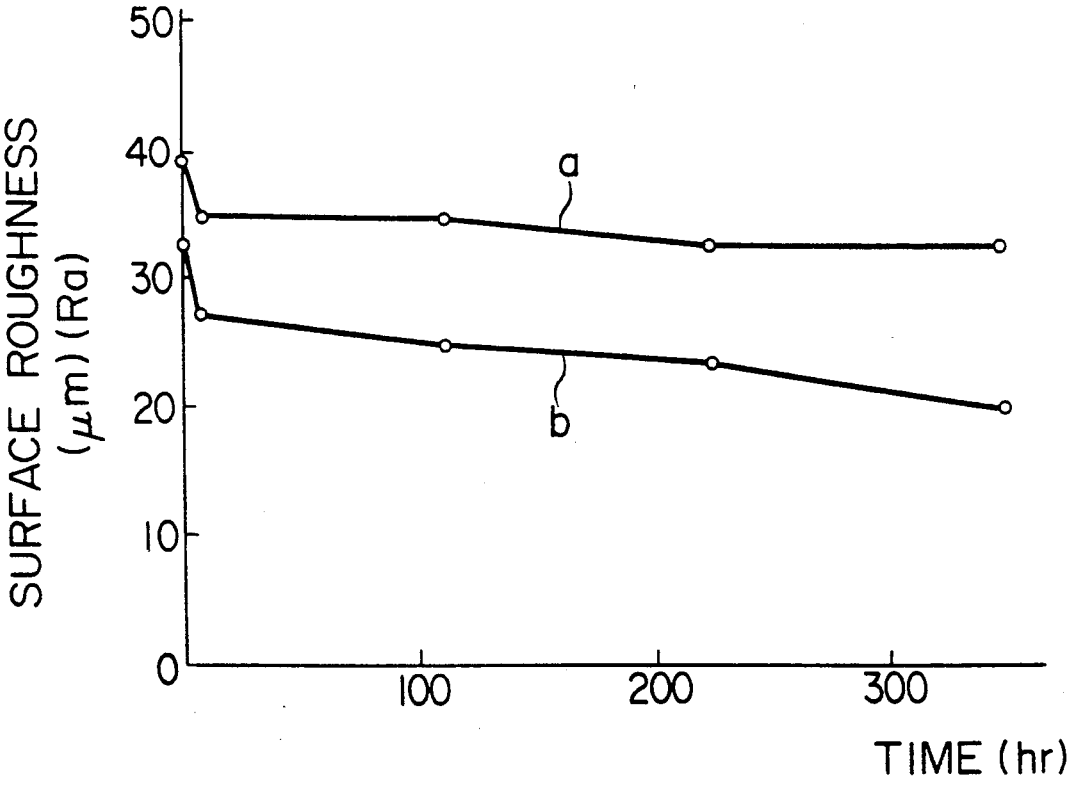
FIG. 4 is a diagram illustrating changes with time in the surface roughness of a sleeve.

FIG. 4 is a diagram illustrating changes with time in the surface roughness of the sleeve. In FIG. 4, symbol a denotes the embodiment of this invention in which SUS310S was sprayed on the surface of the sleeve, whereas symbol b denotes the comparative example in which the surface of the sleeve was shotblasted. As is evident from FIG. 4, the surface of the sleeve in a as the embodiment of this invention has surface roughness in a range of 30–40 μm (Ra), is superior in transferability of the developer, as compared with b as the comparative example, and is subjected to less changes with time in surface roughness. This means that long-term stable developing can be ensured with this invention.

Figure 1:
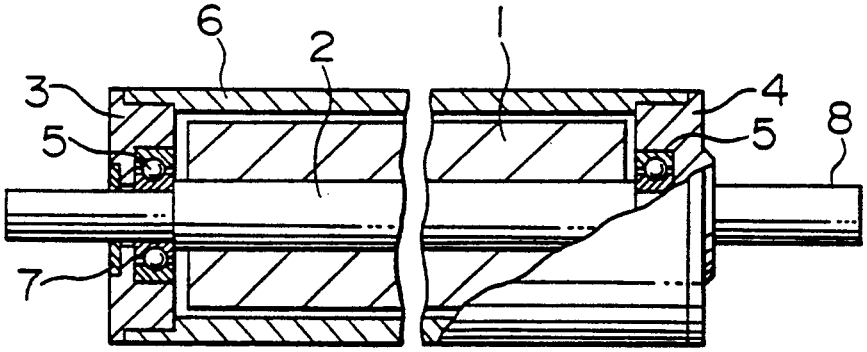
FIG. 1 is a partially omitted longitudinal sectional view of the essential part of a magnet roll to which this invention is directed.

The results of tests with a magnet roll as shown in FIG. 1 manufactured by using a sleeve having the aforementioned construction revealed that the magnet roll shows a high durability of 2.5 million sheets, and is excellent in both the transferability of the developer and image quality.

In this embodiment, description has been made on a hollow tube made of SUS304 as the base metal of the sleeve. However, other grades of stainless steel can be used, and the outside diameter and wall thickness of the sleeve can be selected appropriately, depending on the specifications of the copying machine to which the roll is applied. As the metal-spraying material, other grades of stainless steel than SUS310S can be used. The thickness of the metal-sprayed film can also be selected appropriately within the range of 20–100 μm. That is, forming a metal-sprayed film of thicknesses less than 20 μm is practically extremely difficult, while forming a metal-sprayed film having thicknesses more than 100 μm is unfavorable in terms of manufacturing cost. Furthermore, plasma-jet heating, high-frequency induction heating, and direct heating by applying discharging current may also be employed in addition to arc-discharge heating. Beside these electric metal-spraying means, gas metal-spraying means may also be used.

It should be noted, however, that arc metal spraying is most desirable among these metal-spraying means due to simple operation, large metal-spraying capacity, and compact system size. Arc metal spraying can be applied using commercial equipment ("METOCO" type metal spraying equipment, for example) under a low-D.C. voltage high-current condition of 18–40 V, and 100–800 A. The metal-spraying weight should preferably be 3–8 kg/hr for high-chromium stainless steels, as used in this invention (100–200 A). Metal spraying on the sleeve is normally carried out after pre-treatment, such as degreasing, blasting and preheating.

This invention having the aforementioned construction and operation can accomplish the following effects.

(1) Since the sleeve is made of stainless steel, temperature rise due to eddy currents can be minimized. This makes this invention particularly useful in applications involving high-speed revolution.

(2) Since the surface of the sleeve is roughened by applying a metal-sprayed film, the transferability of developer can be improved.

(3) Since the surface of the sleeve is formed with a metal-sprayed film of stainless steel, the wear resistance and service life of the roll can be improved.

(4) Since no rust is formed on the surface, as often found in conventional rolls, high-quality images can be produced.

What is claimed is:

1. A magnet roll, comprising:

a permanent-magnet member having a plurality of magnet poles extending axially on an outer circumferential surface of said permanent-magnet member;

a hollow cylindrical sleeve, formed of a non-magnetic stainless steel, each of said hollow cylindrical sleeve and said permanent-magnet member being provided in a mutually rotatable fashion via a flange provided on each end of said hollow cylindrical sleeve;

a metal-sprayed film deposited on a surface of said stainless steel hollow cylindrical sleeve by spraying a stainless-steel metal spraying material on said stainless steel hollow cylindrical sleeve, said stainless-steel metal-spraying material containing more than 20% chromium.

2. A magnet roll as set forth in claim 1 wherein said metal-sprayed film has both normal portions having high chromium contents and low-chromium portions; the chromium contents of said normal portions being more than 20 wt. %.

3. A magnet roll as set forth in claim 2 wherein the chromium contents of said low-chromium portions in said metal-sprayed film are more than 10 wt. %.

4. A magnet roll, comprising:

a permanent-magnet member having a plurality of magnet poles extending axially on an outer circumferential surface of said permanent-magnet member;

a non-magnetic stainless-steel hollow cylindrical sleeve, said hollow cylindrical sleeve being connected via flanges for rotation with respect to said permanent-magnet member;

a coating of stainless-steel containing more than 20% chromium, said coating of stainless-steel being applied as a metal-sprayed film deposited on a surface of said non-magnetic stainless-steel hollow cylindrical sleeve by spraying.

5. A magnet roll according to claim 4, wherein said non-magnetic stainless-steel hollow cylindrical sleeve includes 18.0–20.0% chromium and 8.0–10.5% nickel.

6. A magnetic roll according to claim 4, wherein said stainless-steel coating includes 24.0–26.0% chromium and 12.0–15.0% nickel.

7. A magnet roll as set forth in claim 1 wherein said metal-sprayed film has both normal portions having high chromium contents and low-chromium portions; the chromium content of said normal portions being more than 20 wt. %.

8. A magnet roll as set forth in claim 2 wherein the chromium content of said low-chromium portions in said metal-sprayed film are more than 10 wt. %.

* * * * *